United States Patent [19]

St. Jean

[11] 4,111,390

[45] Sep. 5, 1978

[54] APPARATUS ORIENTATING ARRANGEMENT

[75] Inventor: Herbert N. St. Jean, New Milford, Conn.

[73] Assignee: Arrowhead Enterprises, Inc., New Milford, Conn.

[21] Appl. No.: 773,707

[22] Filed: Mar. 2, 1977

[51] Int. Cl.[2] ..... E06B 9/17

[52] U.S. Cl. ..... 248/274; 248/220.1

[58] Field of Search ..... 248/274, 220.1, 242, 248/DIG. 6; 312/245

[56] References Cited

U.S. PATENT DOCUMENTS

| | | | |
|---|---|---|---|
| 1,759,544 | 5/1930 | Croes | 312/245 |
| 1,853,203 | 4/1932 | Cluny | 248/DIG. 6 |
| 1,963,951 | 6/1934 | Bowers | 248/DIG. 6 |
| 2,480,805 | 8/1949 | Buckel | 248/DIG. 6 |

FOREIGN PATENT DOCUMENTS

| | | | |
|---|---|---|---|
| 1,425,899 | 2/1976 | United Kingdom | 248/DIG. 6 |

*Primary Examiner*—Robert A. Hafer

*Attorney, Agent, or Firm*—Garold E. Bramblett, Jr.

[57] ABSTRACT

An improved arrangement for orientating an apparatus which is adapted to transmit, receive or relay electromagnetic or acoustical energy is described. The apparatus includes a housing and a housing positioning means and a housing mounting means are provided for mounting the housing to a support body. The housing includes a housing member having an elongated surface which is adapted to be positioned adjacent a surface of the support body. The housing surface has a cross-section configuration for providing a first plurality of alternative orientations for the apparatus while the housing positioning means is adapted to be located between, and in contact with, the housing member surface and the support body and to cooperate with the housing member surface to provide a second plurality of alternative apparatus orientations.

12 Claims, 17 Drawing Figures

Fig. 1.
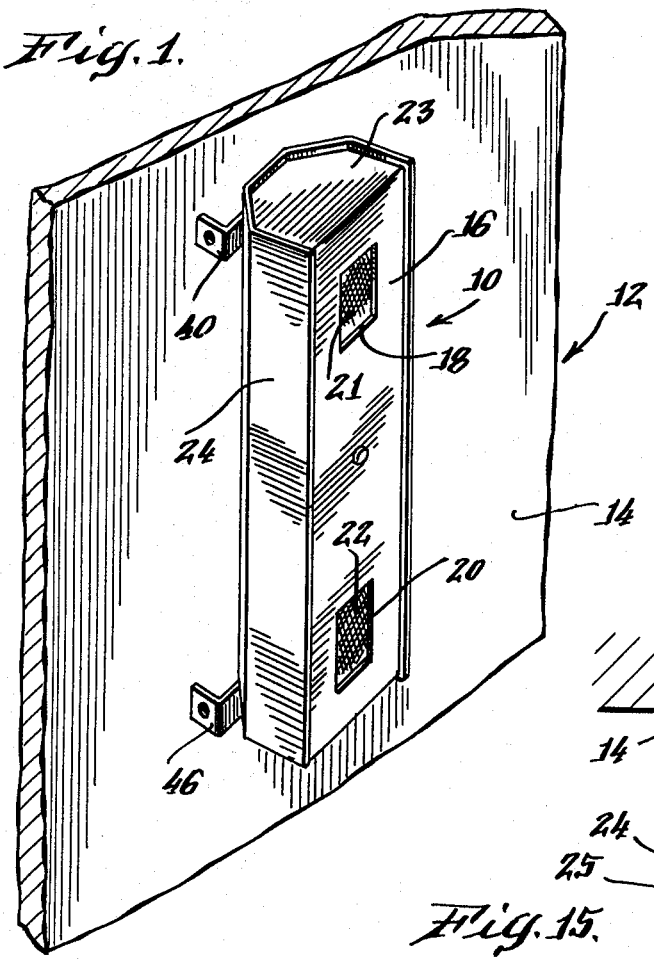
Fig. 16.
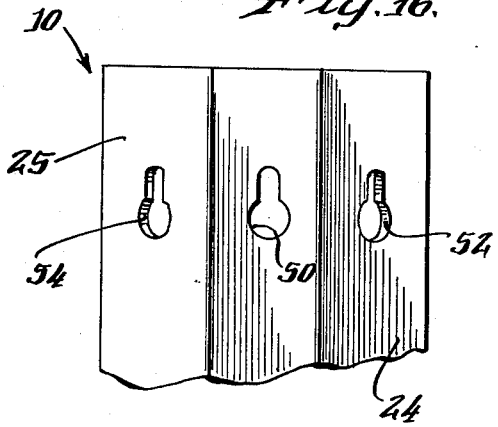
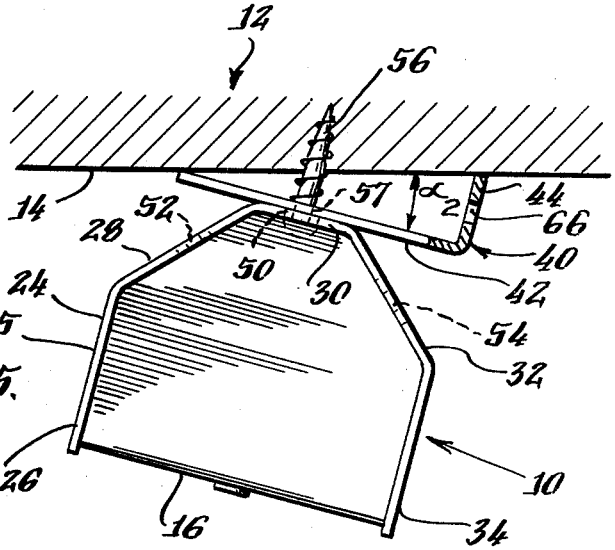
Fig. 15.
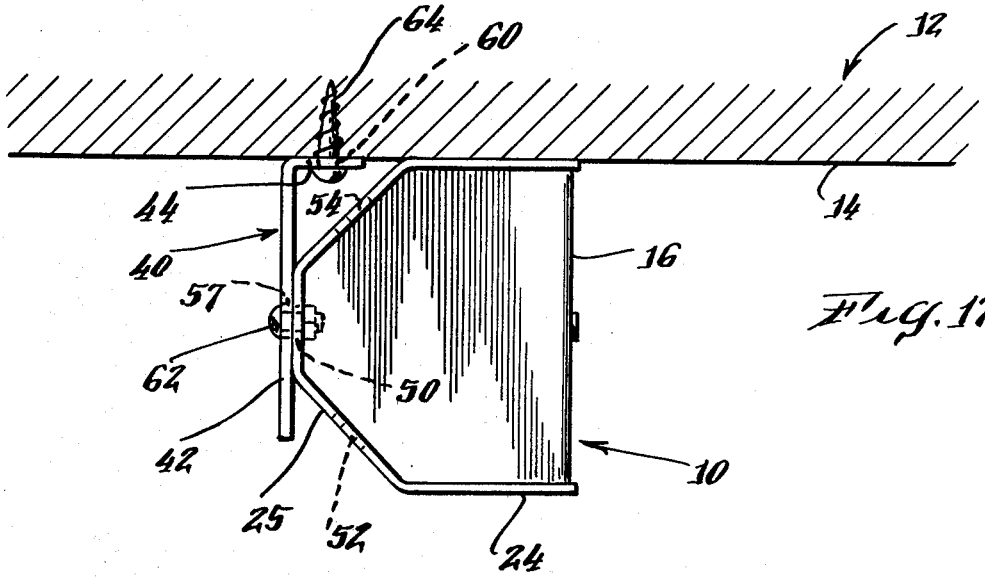
Fig. 17.

APPARATUS ORIENTATING ARRANGEMENT

BACKGROUND OF THE INVENTION

This invention relates to the orientation of an apparatus, which is adapted to transmit, receive or relay electromagnetic or acoustical energy, with respect to another apparatus, an object or a space.

Various apparatus which are adapted to transmit, receive, or relay electromagnetic or acoustical energy have a preferred orientation with respect to another apparatus, an object or a space. An apparatus having a preferred orientation with respect to another apparatus comprises, for example, a component of an acoustical or photoelectric detection system which is utilized for intrusion detection, for control, etc. The system includes a transmitter which projects a beam of acoustical or radiant energy toward a remotely located receiving apparatus. Variations in beam transmission are sensed by the receiver and an indication thereof is provided. Apparatus having a preferred orientation with respect to an object or a space include surveillance cameras and intrusion alarms of the acoustical and radio frequency type. Each of the described apparatus provide more effective operation when they are orientated by positioning an operative transducer, antenna, reflector, lens, etc., with respect to the other apparatus, or object or space.

In prior arrangements, a means has been provided for adjusting or varying the orientation of the apparatus. These arrangements exhibit several undesirable characteristics. For example, many ultrasonic transceivers utilize a swivel bracket assembly for orientating the apparatus in order to direct an ultrasonic pattern toward a space which is not perpendicular to the available mounting surface. The swivel bracket inhibits close positioning of the apparatus to a mounting surface. Swivel bracket mounting is generally accomplished with a cantilever structure which undesirably renders the apparatus susceptible to vibration. In addition, the prior arrangements have been relatively complex or costly or have not provided the desired degree of flexibility for varying the orientation of the apparatus.

Accordingly, it is an object of this invention to provide in an apparatus adapted to transmit, receive, or relay electromagnetic or acoustical energy, an improved means for orientating the apparatus with respect to another apparatus, an object or a space.

Another object of the invention is to provide an improved orientating means for an apparatus of the type described which is adaptable for varying the orientation of the apparatus.

Another object of the invention is to provide an improved quantitative means for the apparatus of the type described which reduces vibrations in the apparatus.

Another object of the invention is to provide a relatively simple, non-complex and economical means for providing selectable alternative orientations of the apparatus.

Another object of the invention is to provide a relatively simple, non-complex and economical means for providing progressively varying orientation of the apparatus.

SUMMARY OF THE INVENTION

In accordance with features of the present invention, there is provided in an apparatus adapted to transmit, receive or relay electromagnetic or acoustical energy, an improved means for orientating the apparatus with respect to another apparatus, an object or a space comprising a housing for the apparatus, a housing positioning means and a means for mounting the housing and the housing positioning means to a support body. The housing includes a member having an elongated surface which is adapted to be positioned adjacent a surface of the support body. The housing surface has a cross-sectional configuration for providing a first plurality of alternative orientations of the apparatus. The housing positioning means is adapted to be located between, and in contact with, the housing member surface and the support body and it cooperates with the housing member surface to provide a second plurality of alternative apparatus orientations.

In accordance with more particular features of the invention, the housing member surface has a cross-sectional configuration including a plurality of flat, elongated surface segments. Juxtaposed segments are disposed in non-parallel relationship. Each of the surface segments is adapted to be alternatively positioned adjacent a flat surface of the support body and these alternative positions provide the first plurality of alternative orientations. The housing positioning means is adapted to cooperate with the surface segments to alter the orientations established by the segments thereby providing the second plurality of alternative orientations. In a preferred arrangement, the surface segments provide a first plurality of progressively varying orientations and the second plurality of orientations are incremental variations intermediate the orientations of the first plurality of progressively varying orientations. The housing positioning means comprises a bracket for contacting a flat surface segment of the housing member surface and spacing the housing from a flat wall of a support body.

BRIEF DESCRIPTION OF THE DRAWINGS

These and other objects and features of the invention will become apparent with reference to the following specification and to the drawings wherein:

FIG. 1 is a perspective view of an apparatus of the type described illustrating an embodiment of an improved orientating means;

FIG. 15 is an enlarged plan view of the apparatus of FIG. 1 illustrating a housing positioning means positioning the apparatus at one of the second plurality of intermediate orientations;

FIG. 16 is a fragmentary view of a housing member surface segment illustrating a mounting aperture formed therein; and, FIG. 17 is an enlarged plan view of the apparatus of FIG. 1 illustrating alternative mounting of the apparatus at the orientation illustrated in FIG. 6.

DETAILED SPECIFICATIONS

Figure 2:
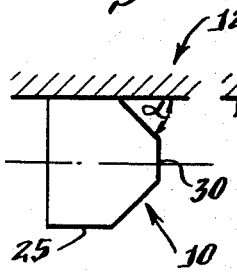
FIGS. 2, 3, 4, 5 and 6 are plan views of the apparatus of FIG. 1 illustrating the orientation of the apparatus in a first plurality of alternative progressing orientations.
Figure 3:
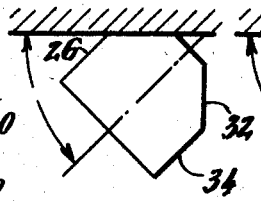
Figure 4:
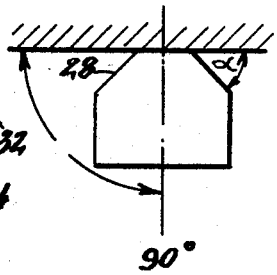
Figure 5:
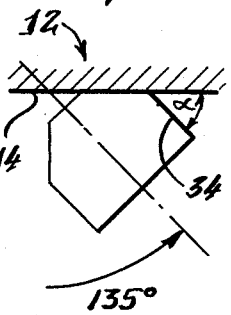
Figure 6:
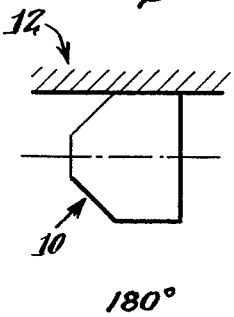
Figure 7:
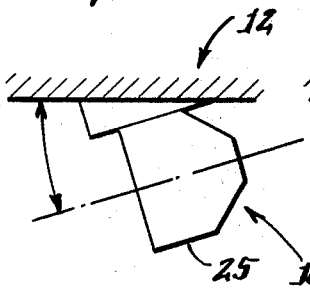
FIGS. 7–14 are plan views of the apparatus of FIG. 1 illustrating the orientation of the apparatus at a second plurality of alternative progressively varying intermediate orientations.
Figure 8:
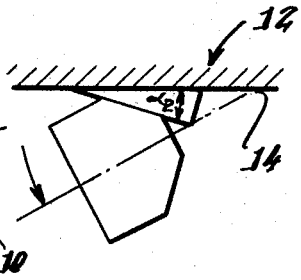
Figure 9:
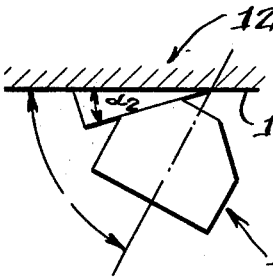
Figure 10:
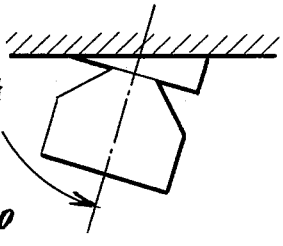
Figure 11:
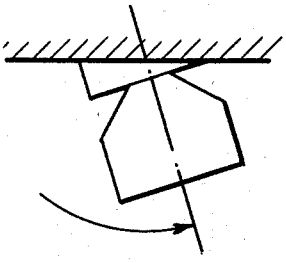
Figure 12:
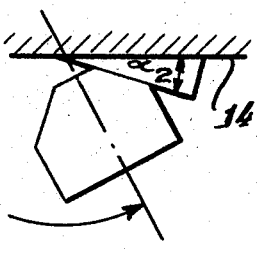

Referring now to FIG. 1, an apparatus 10 shown therein is adapted to transmit, receive or relay electromagnetic or acoustical energy. The apparatus 10 comprises a component of a communication, detection, control, surveillance or other similar system. The apparatus comprises, for example, a transmitter, a receiver, a transceiver or a reflector of electromagnetic or acoustical energy. Apparatus adapted to operate responsive to electromagnetic energy can operate in the visible and invisible light spectrum and in the radio frequency spectrum. In the light spectrum, the beams may comprise visible collimated light or laser beams or invisible light beams in the infrared range. These beams are projected between various forms of known light radiant energy transmitters, receivers and reflectors. A light radiant energy receiver may also comprise a surveillance camera of the photographic or electronic video type. In the radio frequency spectrum, the apparatus may comprise a radio frequency transmitter, receiver, transceiver, or reflector which projects, receives, or reflects a beam of radiant energy being transmitted between remotely located apparatus. Alternatively, the beam is reflected from an object in the range of the path of the beam, or, the radio frequency floods an area with a radiation envelope or pattern and which, upon disturbance of the pattern, is detected. Alternatively, the projected and reflected energy is acoustical energy which is projected at, received from or reflected by another apparatus, an object or a space. In FIG. 1, the apparatus 10 is shown to comprise an acoustical transducer useful in an acoustical intrusion alarm system.

The apparatus 10 is mounted in a vertical attitude to a rigid support body 12. The support body is a building structure shown to comprise a relatively flat wall formed of wood, plasterboard, or other suitable building composition and having a flat surface 14. Alternatively, the apparatus can be mounted in a horizontal attitude or at an angle with respect to the horizontal as desired to satisfy the needs of particular uses. The apparatus can also alternatively be mounted on a transportable support body or on other types of stationary support bodies.

Apparatus of the type referred to generally have a preferred orientation with respect to another remotely located apparatus, an object or a space. The preferred orientation enhances the reception, projection or reflection characteristics and increases the overall efficiency of operation of a system utilizing the apparatus. In the usual application, it is preferable that the apparatus be orientated with respect to another apparatus, an object or the space for providing that the apparatus is pointing directly thereat. Various factors can operate to interfere with the positioning of the apparatus and which operates to inhibit this desired orientation. For example, the mounts or structural supports upon which remotely located apparatus are supported may be so arranged as to inhibit a preferred orientation.

A housing for the apparatus is provided and includes a flat, frontal sheet member 16 having apertures 18 and 20 formed therein for the transmission and reception of acoustical energy therethrough. Acoustical transducers are positioned behind the mesh screens 21 and 22 of apertures 18 and 20 respectively. The housing further includes a first end member 23 and a second, oppositely positioned end member not visible in the views of drawings. The housing further includes an elongated, shell shaped member 24 having a surface 25 which is adapted to be positioned adjacent the surface 14 of the support body 12. The housing shell member 24 has a cross-sectional configuration for providing a first plurality of alternative orientations of the housing with respect to another apparatus, or object or space. The cross-sectional configuration includes a plurality of flat, elongated surface segments 26, 28, 30, 32 and 34 (FIG. 15) wherein juxtaposed segments are formed with a nonparallel relationship. Each of these segments is flat and is therefore adapted to be alternatively positioned adjacent the flat surface 14 of the support body 12 to provide the first plurality of alternative orientations as illustrated in FIGS. 2, 3, 4, 5 and 6.

The cross-sectional configuration is formed to provide a plurality of progressively varying orientations of the housing which vary progressively in a same direction of angular orientation. In these figures, the housing orientation is shown to progress in a counterclockwise direction in the sequence of FIGS. 2, 3, 4, 5 and 6. In those figures, the orientation of the housing varies progressively at an angle of 45° as determined by the angular relationship between the non-parallel juxtaposed segments. Additional surface segments can be provided and the angle $\alpha_1$ of progression between juxtaposed segments can be varied.

A housing positioning means 40 (FIG. 15) is provided and is adapted to be located between and in contact with the housing member surface 25 and the surface 14 of the support body 12. The housing positioning means is shown in FIG. 15 to comprise a body 40 which is adapted to alternatively contact and position one of the flat housing segments 26, 28, 30, 32 or 34 at an angular orientation $\alpha_2$ with respect to the surface 14 of the support body 12. The body 40 comprises a bracket, formed rigidly of metal for example, and having first and second integrally formed leg segments 42 and 44 respectively.

Figure 13:
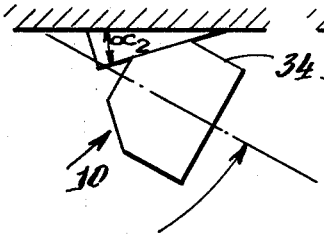
Figure 14:
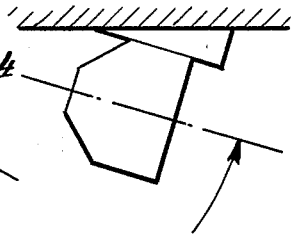

The housing positioning means 40 cooperates with the housing member 24 to provide a second plurality of orientations of the housing. The second plurality of orientations occur at angular orientations which are intermediate the first plurality of orientations. In FIGS. 2, 3, 4, 5 and 6, it was seen that the progressive housing orientations vary by the angle $\alpha_1$ which, in a preferred arrangement, is 45°. The bracket 40 (FIG. 15) is dimensioned for establishing an angle $\alpha_2$ with respect to the leg 42 and its flat housing surface 14. Positioning a flat surface segment 26, 28, 30, 32 or 34 against the leg 42 establishes orientation for the segment differing from the first plurality of orientations. For example, in FIG. 5, the segment 34 has an angular orientation of $\alpha_1$ with respect to the surface 14 and the apparatus has an orientation of 135°. In FIG. 13, the orientation means 40 has reduced the relation between the segment 34 and surface 14 to 30° ($\alpha_1-\alpha_2$) and the housing has an orientation of 150°. Similar intermediate orientations occur for other surface segments. As indicated hereinbefore, the first plurality of alternative progressively varying orientations is provided as a result of the cross-sectional configuration of the housing member 24, and, for $\alpha_1 =$ 45°, is shown to be 0°, 45°, 90°, 135°, and 180°. The second plurality of orientations which are intermediate the first plurality of progressively varying orientations are, for $\alpha_2 = 15°$, equal to 15°, 30°, 60°, 75°, 105°, 120°, 150° and 165°. By alternatively positioning the flat surface segment of the housing adjacent the wall surface 14 and by utilizing the positioning bracket, the various progression in orientations can be provided.

As illustrated in FIG. 1, first and second brackets 40 and 46 respectively are positioned between the flat housing member surface segment 30 and the flat support body surface 14 at spaced apart locations along the length of the flat elongated surface segment. The use of two or more brackets as illustrated stabilizes the housing along its length.

A means for mounting the housing and the housing positioning means to the support body 12 is provided by apertures 50, 52 and 54 formed in housing member 24 on the surface segments at locations along their length. The mounting means also include a screw member 56 adapted for engaging the apertures and for engaging the body 12. The screw 56 comprises, for example, a wood screw which is set at an angle in the body 12 as illustrated and engages the aperture 50 in the wall segment. An aperture 57 is formed in the bracket leg segment 42 and the screw 56 extends through this aperture.

The housing member cross-sectional configuration includes first and second distal segments 26 and 34 which are adapted for alternative positioning adjacent the flat support body surface 14. At times it is preferable for purposes of appearance and uninterrupted design to avoid the use of mounting apertures in these segments since they are displayed and are readily visible. The positioning body 40, as illustrated in FIG. 17, includes an aperture 60 formed in the leg segment 44 as well as the aperture 57 formed in leg segment 42. The mounting means secures the housing to the support body 12 by engagement between the leg segment 42 and a flat housing surface segment with a screw and nut assembly 62 and engagement between the leg segment 44 and the body 12 with a screw 64. The housing may thereby be mounted with the surface segments 26, or alternatively segment 34 adjacent the surface 14 of the support body 12 while eliminating the use of apertures in these surface segments.

While the drawings depict and the specifications describe a housing surface configuration having five juxtaposed surface segments, 26, 28, 30, 32 and 34, the number may be reduced or increased in order to satisfy particular orientation and orientation variation requirements. While the angular relationship between adjacent surface segments is shown to be an angle $\alpha_1$ of 45°, this angular relationship can be varied as needed. Similarly, while the angle $\alpha_2$ established by the length of the leg segments 42 and 44 of the positioning bracket 40 has been described, this angle can also be selected to satisfy particular needs.

There has thus been described an improved orientating arrangement for orientating an apparatus of the type adapted to receive, transmit or reflect electromagnetic or acoustical energy with respect to another apparatus, an object or a space. The improved arrangement is advantageous in that it enables stable orientation and mounting since cantilever brackets are avoided and mounting vibrations reduced. In addition, it provides a plurality of progressively, varying orientations with a relatively non-complex and economical arrangement.

While there has been described a particular embodiment of the invention, it will be apparent to those skilled in the art that variations may be made thereto without departing from the spirit of the invention and the scope of the appended claims.

What is claimed is:

1. In an apparatus adapted to transmit, receive or relay electromagnetic or acoustical energy along a fixed direction relative to said apparatus, an improved means for orientating the apparatus to selectively vary said fixed direction with respect to another apparatus, an object or a space comprising:

A. a housing for the apparatus;

B. said housing having an elongated surface adapted to be positioned adjacent a support body surface, said housing surface having a peripheral configuration defining a plurality of contiguous non-perpendicular planar segments independently mountable on said support body surface for providing a first plurality of alternative orientations of said fixed direction with respect to another apparatus or object or space;

C. housing positioning means adapted to be located between and in contact with a selected one of said housing segments and said support body surface to provide a second plurality of alternative orientations of said fixed direction; and D. means for mounting said housing and said housing positioning means to said support body.

2. The apparatus of claim 1 wherein said segments of said peripheral configuration are formed to provide a plurality of alternative, progressively varying orientations and each of said second plurality of orientations are intermediate said first plurality of progressively varying orientations.

3. The apparatus of claim 2 wherein said housing positioning means comprises a positioning body adapted to alternatively contact and position one of said flat housing segments at an angular orientation with respect to the support body flat surface.

4. The apparatus of claim 3 wherein said housing positioning body comprises a bracket having first and second leg segments.

5. The apparatus of claim 4 wherein said first leg segment is normal to said second leg segment.

6. The apparatus of claim 4 wherein said first and second bracket leg segments have differing lengths.

7. The apparatus of claim 2 wherein said housing positioning means comprises first and second brackets adapted to be positioned between a surface of a flat housing segment and a flat support body surface at spaced apart locations along a length of one of said flat, elongated surface segments.

8. The apparatus of claim 2 wherein said successively located housing segments are adapted for providing orientations which progressively vary by an angle of about 45° and said housing positioning means is adapted to provide incremental orientations of about 15° whereby said housing may be progressively orientated in increments of 15°.

9. The apparatus of claim 3 wherein said housing includes apertures formed in a plurality of said flat surfaces, said positioning body includes an aperture formed therein, and said mounting means engages said housing at one of said housing apertures, extends through said bracket aperture and engages said support body.

10. The apparatus of claim 9 wherein said plurality of housing segments of said housing peripheral configuration includes first and second distal segments adapted for alternative positioning adjacent the flat support body surface, said housing engages said first leg segment and said positioning body engages said support body.

11. The apparatus of claim 9 wherein said mounting means comprises a screw.

12. The apparatus of claim 2 wherein said apparatus comprises an ultrasonic transceiver.

* * * * *